US010448131B1

(12) United States Patent
Tanaka et al.

(10) Patent No.: US 10,448,131 B1
(45) Date of Patent: Oct. 15, 2019

(54) SOUND OUTPUT APPARATUS

(71) Applicant: DENSO TEN Limited, Kobe-shi, Hyogo (JP)

(72) Inventors: Takashi Tanaka, Kobe (JP); Yutaka Matsunami, Kobe (JP)

(73) Assignee: DENSO TEN Limited, Kobe-shi (JP)

( * ) Notice: Subject to any disclaimer, the term of this patent is extended or adjusted under 35 U.S.C. 154(b) by 0 days.

(21) Appl. No.: 16/287,136

(22) Filed: Feb. 27, 2019

(30) Foreign Application Priority Data

Apr. 13, 2018 (JP) ..... 2018-077864

(51) Int. Cl.
*H04R 1/02* (2006.01)
*H04R 7/04* (2006.01)

(52) U.S. Cl.
CPC ..... *H04R 1/028* (2013.01); *H04R 7/045* (2013.01); *H04R 2499/15* (2013.01)

(58) Field of Classification Search
CPC ..... H04R 1/028; H04R 7/045; H04R 2499/15
See application file for complete search history.

(56) References Cited

U.S. PATENT DOCUMENTS 10,200,772 B2 * 2/2019 Ahn ..... G06F 1/1688
2016/0170539 A1 * 6/2016 Watanabe ..... H04M 19/047 345/173
2017/0105294 A1 * 4/2017 Shimoda ..... H04M 1/02

FOREIGN PATENT DOCUMENTS

JP 2015-219528 A 12/2015

* cited by examiner

*Primary Examiner* — Andrew L Sniezek
(74) *Attorney, Agent, or Firm* — Oliff PLC

(57) ABSTRACT

A sound output apparatus outputs sound from a side of the apparatus on which a display is located. The sound output apparatus includes: a display element that includes the display; a driven element that is driven in accordance with a drive signal; a transmission panel that transmits vibrations of the driven element to the side of the apparatus on which the display of the display element is located; and a cover panel that is placed on an opposite side of the display element than the driven element. The transmission panel is placed between the display element and the driven element, and is joined at least to a portion of a periphery region of the cover panel. The cover panel has the periphery region that extends around an outer periphery of the cover panel as viewed from the side of the apparatus on which the display is located.

9 Claims, 7 Drawing Sheets

SOUND OUTPUT APPARATUS

BACKGROUND OF THE INVENTION

Field of the Invention

The invention relates to a sound output apparatus.

Description of the Background Art

A variety of technologies for effectively outputting sound have been proposed for a sound output apparatus. For example, a speaker having a diaphragm that is driven by a voice coil bobbin via a ring-form member stiffer than the diaphragm has been proposed. Thus, the speaker can effectively output the sound.

However, in a case where the sound is output by vibrating a display on which an image is displayed, the conventional technology has a problem in which vibrations decrease on a display element that includes the display. Thus, there has been a concern that the vibrations cannot be transmitted to a side on which the display of the display element is located so that sound pressure is lowered.

SUMMARY OF THE INVENTION

According to one aspect of the invention, a sound output apparatus outputs sound from a side of the apparatus on which a display is located. The display displays an image. The sound output apparatus includes: a display element that includes the display; a driven element that is driven in accordance with a drive signal; a transmission panel that transmits vibrations of the driven element to the side of the apparatus on which the display of the display element is located, the transmission panel being placed between the display element and the driven element; and a cover panel that is placed on an opposite side of the display element than the driven element, the cover panel having a periphery region that extends around an outer periphery of the cover panel as viewed from the side of the apparatus on which the display is located. The transmission panel is joined at least to a portion of the periphery region of the cover panel.

According to this configuration, since the sound output apparatus includes the transmission panel, even if a display element of which stiffness is relatively low is used, vibrations can be transmitted to the side on which the display of the display element is located.

According to another aspect of the invention, the transmission panel includes an unjoined region at least a part of which faces the display element, the unjoined region not contacting the display element.

According to this configuration, in a case where a great decrease in vibration on the display element is expected, it is possible to control vibrations of the driven element from decreasing.

Thus, an object of the invention is to effectively output sound from a sound output apparatus that outputs sound from a side on which a display is located.

These and other objects, features, aspects and advantages of the invention will become more apparent from the following detailed description of the invention when taken in conjunction with the accompanying drawings.

DESCRIPTION OF THE EMBODIMENTS

Exemplary embodiments of the invention will be described in detail, with reference to the drawings. The invention is not limited to the embodiments below.

<1. Configuration of Sound Output Apparatus>

Figure 1:
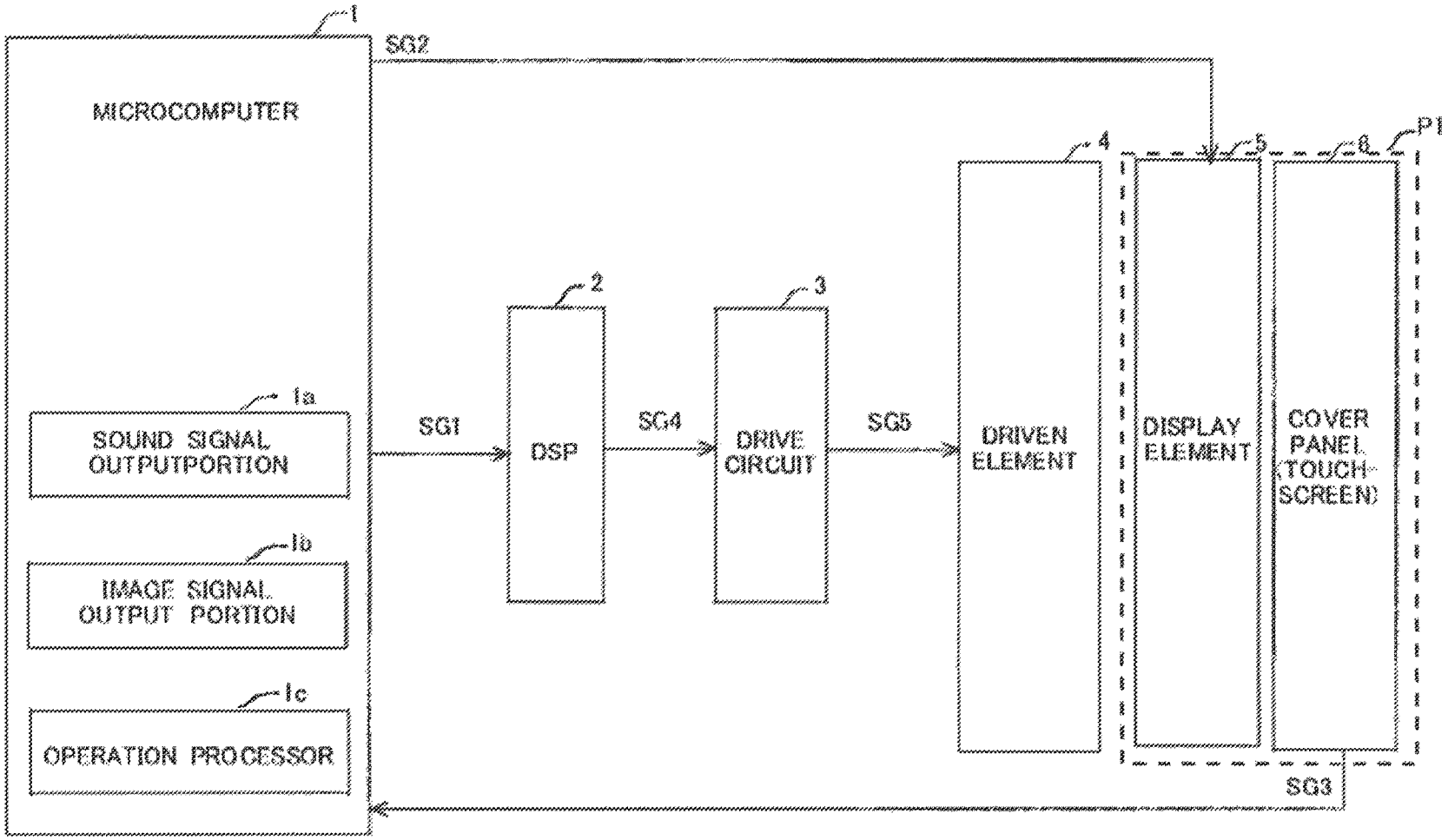
FIG. 1 illustrates a configuration example of a sound output apparatus of this embodiment.

FIG. 1 illustrates a configuration example of a sound output apparatus. The sound output apparatus shown in FIG. 1 includes a microcomputer 1, a digital signal processor (DSP) 2, a drive circuit 3, a driven element 4, and a display panel P1. The display panel P1 includes a display element 5 and a cover panel (touchscreen) 6.

The sound output apparatus shown in FIG. 1 includes: i) a function that outputs sound from a display of the display panel P1 (sound output function); ii) a function that displays an image on the display of the display panel P1 (image display function); and iii) a function that detects an input operation made with the touchscreen of the display panel P1 (operation detection function).

The microcomputer 1 controls the entire sound output apparatus shown in FIG. 1. The microcomputer 1 includes a CPU (Central Processing Unit), a memory and the like, as hardware. The microcomputer 1 includes a sound signal output portion 1*a*, an image signal output portion 1*b*, and an operation processor 1*c*, as software.

The sound signal output portion 1*a* outputs a sound signal SG1 to the DSP 2. The sound signal output portion 1*a* may generate the sound signal SG1 or may obtain the sound signal SG1 from an outside of the microcomputer 1.

The image signal output portion 1*b* outputs an image signal SG2 to the display element 5. The image signal output portion 1*b* may generate the image signal SG2 or may obtain the image signal SG2 from an outside of the microcomputer 1.

The operation processor 1*c* receives a detection signal SG3 that is output from the touchscreen of the display panel P1. The operation processor 1*c* recognizes the input operation with the touchscreen based on the detection signal SG3, and executes a process in accordance with the input operation.

The DSP 2 changes quality of the sound that is output from the sound output apparatus shown in FIG. 1 by executing various types of signal processing of the sound signal SG1. For example, the DSP 2 includes an equalizer function that changes a frequency characteristic of the sound signal. The DSP 2 converts the sound signal SG1 to a sound signal SG4 by executing various types of signal processing of the sound signal SG1, and then outputs the sound signal SG4 to the drive circuit 3.

The drive circuit 3 includes a D/A converter and an amplifier. The D/A converter of the drive circuit 3 converts the sound signal SG4 that is a digital signal into an analogue signal. Being different from this embodiment, the D/A converter may be provided to the DSP 2, the drive circuit 3 may receive the sound signal SG4 that is the analogue signal. The amplifier of the drive circuit 3 amplifies the analogue signal generated by the D/A converter to generate a drive signal SG5, and then outputs the drive signal SG5 to the driven element 4.

<2. Configuration of Display Panel and Adjoining Area Thereof>

<2-1. Configuration Example 1 of Display Panel and Adjoining Area Thereof>

Figure 2:
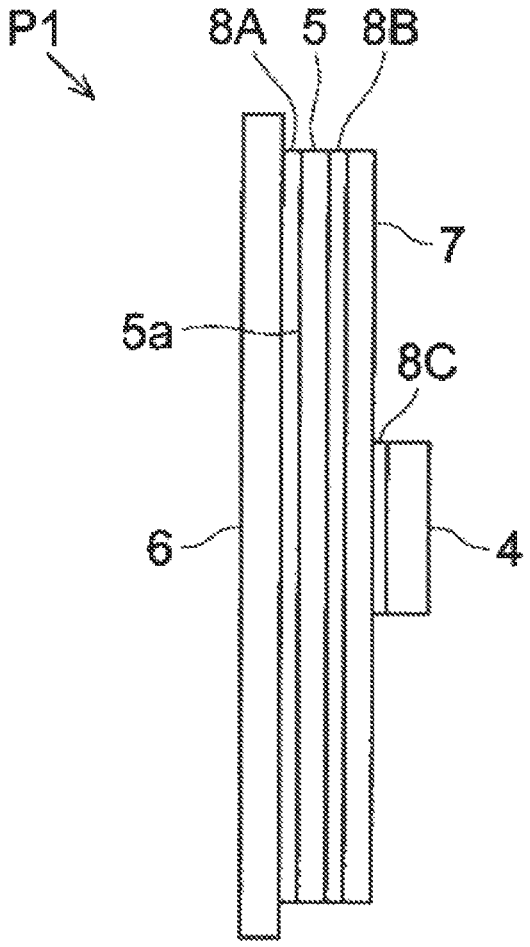
FIG. 2 is a side view illustrating a configuration example 1 of a display panel and an adjoining area thereof.
Figure 3:
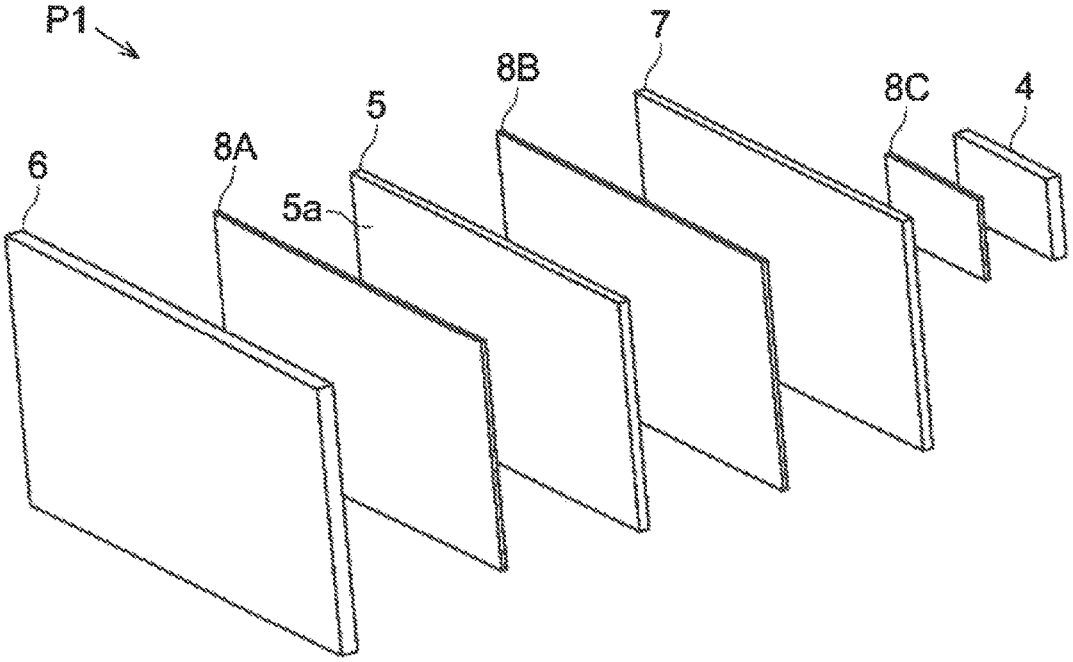
FIG. 3 is an exploded perspective view illustrating the configuration example 1 of the display panel and the adjoining area thereof.

Next described will be a configuration of the display panel P1 and an adjoining area thereof including the driven element 4, with reference to FIGS. 2 and 3. FIG. 2 is a side view illustrating a configuration example 1 of the display panel P1 and the adjoining area thereof of the sound output apparatus shown in FIG. 1. FIG. 3 is an exploded perspective view illustrating the configuration example 1 of the display panel P1 and the adjoining area thereof. A left side of FIGS. 2 and 3 is a front side (side on which an operator is located) of the display panel P1, and is an opposite side of the display element 5 than the driven element 4. A right side of FIGS. 2 and 3 is a back side of the display panel P1, and is also a back side of the display element 5 (a side on which a back surface of the display panel P1/the display element 5 is located).

The driven element 4 is placed to the back side of the display panel P1. One driven element 4 is placed to a vertical and horizontal center of the display panel P1 as viewed from the back side of the display panel P1. The driven element 4 includes, for example, a piezoelectric element. For example, the driven element 4 expands or shrinks in accordance with the drive voltage applied to the driven element 4, and vibrates. The driven element 4 vibrates in accordance with the drive signal SG5 that the driven element 4 receives from the drive circuit 3. Two or more of the driven element 4 may be provided, and may be placed to a portion other than the center of the display panel P1.

The display panel P1 is rectangular in a cuboid form as viewed from the front side of the display panel P1. The display panel P1 includes by the display element 5, the cover panel (touchscreen) 6, a transmission panel 7, and adhesive layers 8A, 8B and 8C shown in FIGS. 2 and 3.

The display element 5 includes the display 5*a* on which an image is displayed. The display 5*a* of the display element 5 faces in a direction of the front side (the side of an operator) of the display panel P1. The display element 5 is a rectangular as viewed from the front side of the display panel P1, and includes, for example, an organic electro luminescence (EL) film. The display element 5 displays the image on the display 5*a* based on the image signal SG2 that the display element 5 receives from the microcomputer 1.

The cover panel 6 is placed to the front side of the display panel P1 that is the opposite side of the display element 5 than the driven element 4. The cover panel has a periphery region that extends around an outer periphery of the cover panel as viewed from the side of the apparatus on which the display is located. The cover panel 6 is a rectangular panel having a size equal to or greater than a size of the display element 5 as viewed from the front side of the display panel P1. The cover panel 6 covers an entire surface of the display 5*a* of the display element 5. The cover panel 6 is made of, for example, glass. The touchscreen is placed to a back side of the cover panel 6, and is between the display 5*a* of the display element 5 and the cover panel 6.

The touchscreen outputs the detection signal SG3 to the microcomputer 1. The detection signal SG3 is indicative of a contact state of an operation object, such as a finger of the operator and a stylus pen, and includes information of presence or absence of contact of the operation object with the touchscreen. Moreover, in a case where the operation object contacts the touchscreen, the detection signal SG3 includes information of a contact position of the operation object.

A detection method for the touchscreen is not especially defined here. However, it is recommended that the touchscreen should be a capacitive touchscreen because if the touchscreen is a capacitive touchscreen, it is possible to detect not only contact but also an approach of the operation object to the touchscreen. In a case where the touchscreen is the capacitive touchscreen, the detection signal SG3 is indicative of an approaching state of the operation object to the touchscreen, in addition to the contact state of the operation object with the touchscreen. In this case, the detection signal SG3 includes information of presence or absence of the approach of the operation object to the touchscreen. Moreover, in a case where the operation object is approaching the touchscreen, the detection signal SG3 includes information of an approaching position of the operation object.

The transmission panel 7 is placed to the back side of the display element 5 between the display element 5 and the driven element 4. The transmission panel 7 is a rectangle panel having a size equal to or greater than the display element 5 as viewed from the front side of the display panel P1. The transmission panel 7 is stiffer than the display element 5. The transmission panel 7 transmits vibrations of the driven element 4 to the display 5*a* of the display element 5.

The adhesive layer 8A is provided, for example, to an entire surface of the display 5*a* of the display element 5, and joins the cover panel 6 and the display element 5 together. The adhesive layer 8A may be, for example, optical clear adhesive (OCA) or optical clear resin (OCR).

The adhesive layer 8B is provided, for example, to an entire front surface of the transmission panel 7, and joins the display element 5 and the transmission panel 7 together. The adhesive layer 8C is provided, for example, to an entire front surface of the driven element 4, and joins the transmission panel 7 and the driven element 4 together.

In the sound output apparatus in the foregoing configuration, the driven element 4 vibrates in accordance with the drive signal SG5 that the driven element 4 receives from the drive circuit 3. The vibrations of the driven element 4 are transmitted to the side on which the display 5*a* of the display element 5 is located, via the transmission panel 7. Thus, sound is output to an outside of the sound output apparatus from the side of the display 5*a* of the sound output apparatus due to vibrations of the cover panel 6.

According to the foregoing configuration example 1, since the sound output apparatus includes the transmission panel 7, the vibrations can be transmitted to the display 5*a* of the display element 5 although the display element 5 has relatively low stiffness. Therefore, the sound can be effectively output by the sound output apparatus that outputs the sound from the side on which the display 5*a* of the display element 5 is located.

It is recommended that a stiff level of the transmission panel 7 should be equal to or greater than the cover panel 6, and that the transmission panel 7 should be made of, for example, glass, resin, metal, or the like. Moreover, the transmission panel 7 should be made of a same material as a material of the cover panel 6, and it is recommended that the transmission panel 7 should be made of glass, resin, or the like. According to the configuration described above, it is possible to effectively vibrate the cover panel 6.

Moreover, it is recommended that the transmission panel 7 should have an electromagnetic shielding function, heat dissipation a function, etc. For example, if light shielding paint is applied to the front side of the display panel P1, the transmission panel 7 may have a good light shielding function. Further, for example, if the transmission panel 7 is made of metal or the like, the transmission panel 7 may have a good electromagnetic shielding function. For example, if the transmission panel 7 is made of glass, metal, or the like, the transmission panel 7 may have a good heat dissipation function. As described above, if the transmission panel 7 has, for example, the light shielding function, the electromagnetic shielding function, the heat dissipation function, etc., it is possible to prevent a possible thermal and/or electromagnetic influence, on the display element 5, that may be caused by the vibrations of the driven element 4.

<2-2. Configuration Example 2 of Display Panel and Adjoining Area Thereof>

Figure 4:
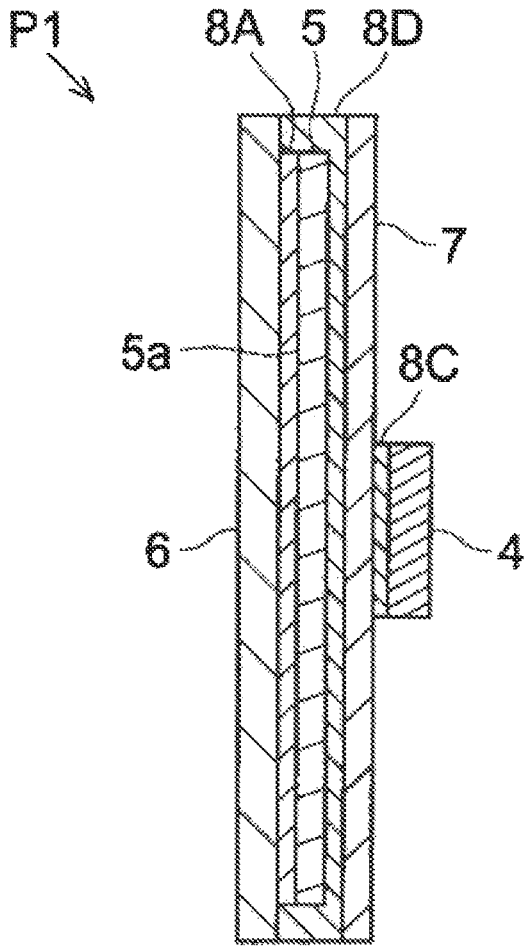
FIG. 4 is a vertical cross sectional side view illustrating a configuration example 2 of a display panel and an adjoining area thereof.
Figure 5:
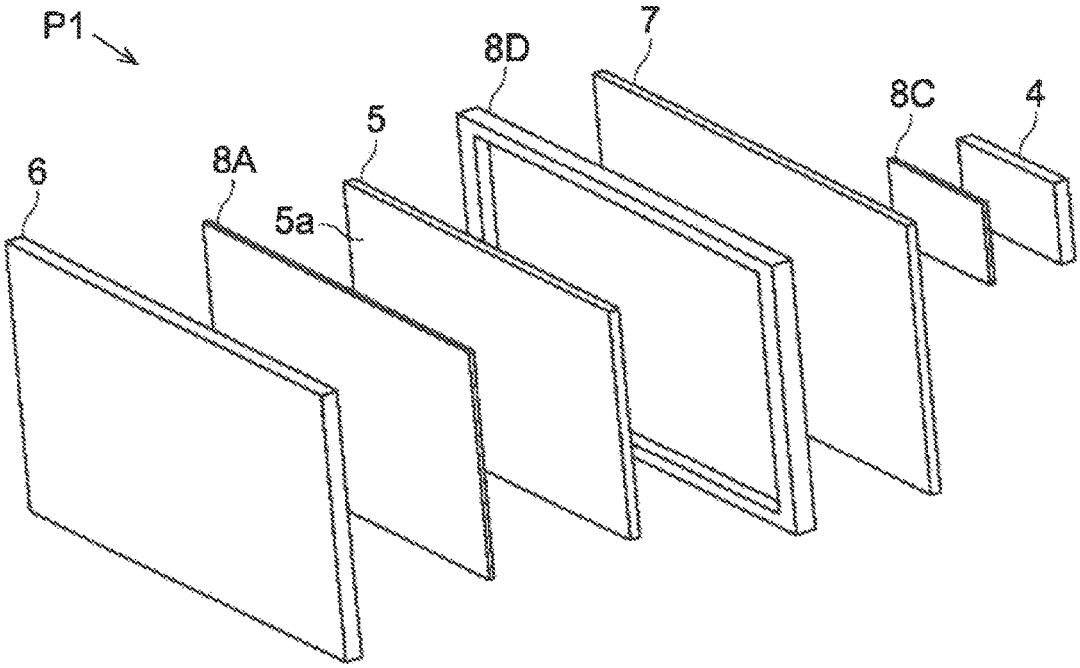
FIG. 5 is an exploded perspective view illustrating the configuration example 2 of the display panel and the adjoining area thereof.

FIG. 4 is a vertical cross sectional side view illustrating a display panel P1 and an adjoining area thereof of the sound output apparatus shown in FIG. 1, as a configuration example 2. FIG. 5 is an exploded perspective view illustrating the configuration example 2 of the display panel P1 and the adjoining area thereof of the sound output apparatus. A left side of FIGS. 4 and 5 is a front side (a side of an operator) of the display panel P1, and is an opposite side of a display element 5 than a driven element 4. A right side of FIGS. 4 and 5 is a back side of the display panel P1, and is also a back side of the display element 5. A basic configuration of this configuration example is the substantially same as the configuration of the foregoing configuration example 1. Thus, a numerical reference and/or a name will be given to a configuration element that is similar to a configuration element in the configuration example 1, and explanation of the similar element will not be described here in some cases.

A transmission panel 7 is a rectangular panel having a size greater than the display element 5 as viewed from the front side of the display panel P1, and substantially same as the size of a cover panel 6.

An adhesive layer 8D is provided to an entire front surface of the transmission panel 7 of the display panel P1, and joins the display element 5 and the transmission panel 7 together. Moreover, the adhesive layer 8D also joins the cover panel 6 and the transmission panel 7 together on an outside region of the display element 5 on upper, lower, left and right sides. The transmission panel 7 is joined to a periphery region of the cover panel 6 on all of the four sides, by the adhesive layer 8D.

The transmission panel 7 may be joined to the periphery region of the cover panel 6 on three sides or less by the adhesive layer 8D. The transmission panel 7 may be partially, not entirely, joined to the periphery region of the cover panel 6 on a side. In other words, the transmission panel 7 is joined at least to a portion of the periphery region of the cover panel 6.

According to the foregoing configuration example 2, the transmission panel 7 of the sound output apparatus is directly joined at least to a portion of the periphery region of the cover panel 6 so that the cover panel 6 is effectively vibrated. Thus, the sound output apparatus that outputs the sound from the side on which the display 5*a* of the display element 5 is located can effectively output the sound.

<2-3. Configuration Example 3 of Display Panel and Adjoining Area Thereof>

Figure 6:
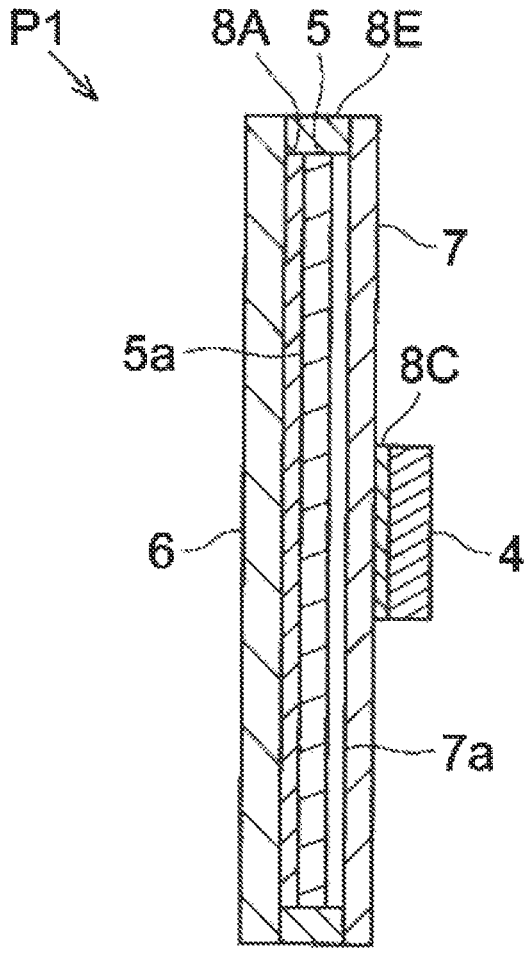
FIG. 6 is a vertical cross sectional side view illustrating a configuration example 3 of a display panel, and an adjoining area thereof.
Figure 7:
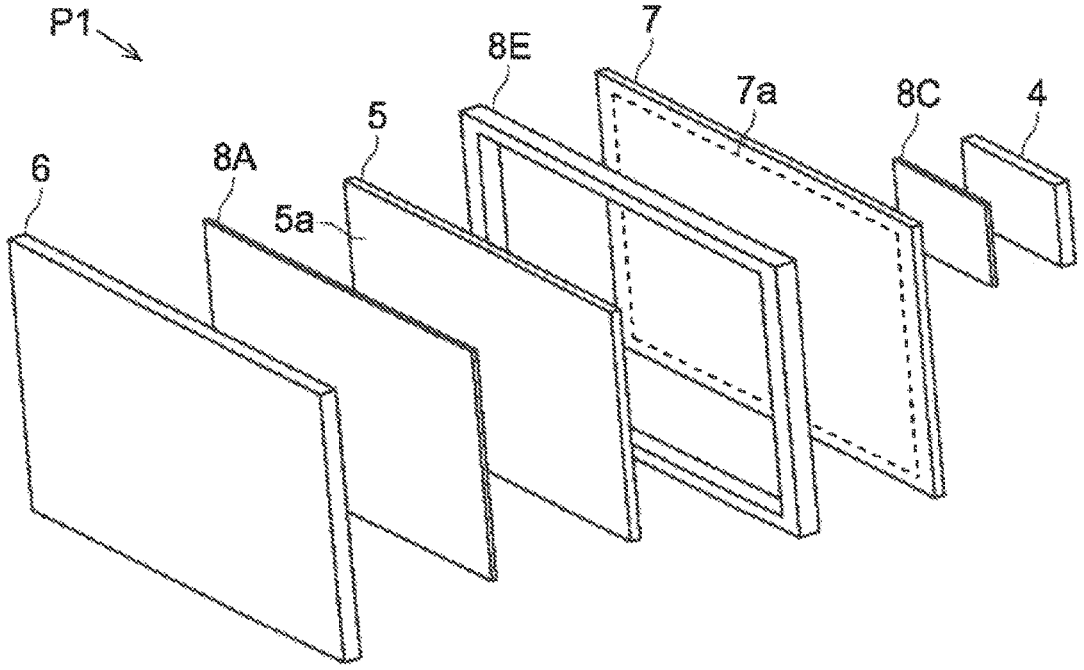
FIG. 7 is an exploded perspective view illustrating a configuration example 3 of the display panel and the adjoining area thereof.

FIG. 6 illustrates a vertical cross sectional side view of a display panel P1 and an adjoining area thereof of the sound output apparatus shown in FIG. 1, as a configuration example 3. FIG. 7 is an exploded perspective view illustrating a configuration example 3 of the display panel P1 and the adjoining area thereof of the sound output apparatus. A left side of FIGS. 6 and 7 is a front side (a side of an operator) of the display panel P1, and is the opposite side of the display element 5 than the driven element 4. A right side of FIGS. 6 and 7 is the back side of the display panel P1, and is also aback side of the display element 5. A basic configuration of this configuration example is the substantially same as the configuration of the foregoing configuration examples 1 and 2. Thus, a numerical reference and/or a name will be given to a configuration element that is similar to a configuration element in the configuration examples 1 and 2, and explanation of the similar element will not be described here in some cases.

A transmission panel 7 is a rectangular panel having a size greater than the display element 5 as viewed from the front side of the display panel P1, and substantially same as the size of a cover panel 6.

An adhesive layer 8E joins the cover panel 6 and the transmission panel 7 together on an outside region of the display element 5 on upper, lower, left and right sides. The transmission panel 7 is joined to a periphery region of the cover panel 6 on all of the four sides, by the adhesive layer 8E. The adhesive layer 8E does not join the entire back surface of the display element 5 to the transmission panel 7. In other words, for example, a void is provided between the back surface of the display element 5 and the front surface of the transmission panel 7. The transmission panel 7 includes an unjoined region 7*a* between the transmission panel 7 and the display element 5.

The unjoined region 7*a* between the display element 5 and the transmission panel 7 may be provided entirely or partially between the transmission panel 7 and the display element 5 on the back side thereof. In other words, the transmission panel 7 includes the unjoined region 7*a* at least a part of which faces the display element 5 and which does not contact the display element 5.

According to the foregoing configuration example 3, since the transmission panel 7 includes the unjoined region 7*a*, the transmission panel 7 may be unjoined to the display element 5 as much as possible. Thus, for example, in a case where a great decrease in vibration on the display element 5 is expected, it is possible to control vibrations of the driven element 4 from decreasing. Thus, the sound output apparatus that outputs the sound effectively outputs the sound from the side on which the display 5*a* of the display element 5 is located.

<3. Others>

In addition to the foregoing embodiments, various technological features disclosed in this specification can be changed without departing from the spirit of the technical invention. In other words, the foregoing embodiments are examples in every aspect, and do not intend to limit the invention. The scope of the invention will be defined by the scope of claims, not by the description in the foregoing embodiments. The scope of the claims should include the scope of claims, equivalents thereof and all changes within the scope.

In the foregoing embodiments, the various functions are implemented by software by the CPU performing the arithmetic process in accordance with the program. However, a part of those functions may be implemented by an electric hardware circuit. Moreover, in the foregoing embodiments, a part of functions that are implemented by a hardware circuit may be implemented by software.

While the invention has been shown and described in detail, the foregoing description is in all aspects illustrative and not restrictive. It is therefore understood that numerous other modifications and variations can be devised without departing from the scope of the invention.

What is claimed is:

1. A sound output apparatus that outputs sound from a side of the apparatus on which a display is located, the display displaying an image, the sound output apparatus comprising:

a display element that includes the display;

a driven element that is driven in accordance with a drive signal;

a transmission panel that transmits vibrations of the driven element to the side of the apparatus on which the display of the display element is located, the transmission panel being placed between the display element and the driven element; and a cover panel that is placed on an opposite side of the display element than the driven element, the cover panel having a periphery region that extends around an outer periphery of the cover panel as viewed from the side of the apparatus on which the display is located, wherein the transmission panel is joined at least to a portion of the periphery region of the cover panel.

2. The sound output apparatus according to claim 1, wherein the transmission panel includes an unjoined region at least a part of which faces the display element, the unjoined region not contacting the display element.

3. The sound output apparatus according to claim 2, wherein the unjoined region is separated from the display element by a gap.

4. The sound output apparatus according to claim 1, wherein the transmission panel is joined to the periphery region of the cover panel by an adhesive layer.

5. The sound output apparatus according to claim 1, wherein the cover panel is a touchscreen.

6. The sound output apparatus according to claim 1, wherein the driven element vibrates in response to the drive signal.

7. The sound output apparatus according to claim 6, wherein the driven element is a piezoelectric element.

8. The sound output apparatus according to claim 1, wherein a stiffness of the transmission panel is greater than a stiffness of the display element.

9. The sound output apparatus according to claim 1, wherein sizes of the cover panel and of the transmission panel, as viewed from the side of the apparatus on which the display is located, are larger than a size of the display element as viewed from the side of the apparatus on which the display is located.

* * * * *